US005466088A

United States Patent [19]

Nasatka

[11] Patent Number: 5,466,088

[45] Date of Patent: Nov. 14, 1995

[54] VEHICLE BARRIER HAVING A PIVOTAL VEHICLE BARRICADE AND A COOPERATING PIVOTAL SIGNAL BARRIER

[76] Inventor: Ralph G. Nasatka, 8405 Dangerfield Pl., Clinton, Md. 20735-2814

[21] Appl. No.: 185,247

[22] Filed: Jan. 24, 1994

[51] Int. Cl.[6] ..... E01F 13/06; E01F 13/08

[52] U.S. Cl. ..... 404/6; 49/49; 49/131

[58] Field of Search ..... 404/6, 9, 10, 11, 404/14; 49/35, 49, 131

[56] References Cited

U.S. PATENT DOCUMENTS

| | | | |
|---|---|---|---|
| 3,320,698 | 5/1967 | Hummel | 49/340 |
| 3,773,385 | 11/1973 | Sandberg | 298/23 MD |
| 3,823,510 | 7/1974 | Panaccione | 49/247 |
| 4,016,679 | 4/1977 | Ellefson | 49/49 |
| 4,101,235 | 7/1978 | Nelson | 404/6 |
| 4,318,079 | 3/1982 | Dickinson | 340/127 |
| 4,490,068 | 12/1984 | Dickinson | 404/6 |
| 4,574,523 | 3/1986 | Nasatka | 49/49 |
| 4,630,395 | 12/1986 | Nasatka | 49/49 |
| 5,146,710 | 9/1992 | Caldwell | 404/6 X |
| 5,228,237 | 7/1993 | Nasatka | 49/49 |

*Primary Examiner*—Ramon S. Britts
*Assistant Examiner*—James A. Lisehora
*Attorney, Agent, or Firm*—Joseph W. Berenato, III

[57] ABSTRACT

A vehicle barrier having a vehicle barricade and a cooperating signal barrier for roadways or the like is provided. The vehicle barricade is pivotally connected to a housing, and is pivotal between a first generally horizontal position and a second angularly disposed position. A signal barrier cooperates with the vehicle barricade, and pivots between a first generally vertical position and a second generally horizontal position. A linear actuator is operably associated with the housing. A transmission is operably associated with the linear actuator and the vehicle barricade and the signal barrier for converting linear movement into pivotal movement of the vehicle barricade and signal barrier so that the barricade and the signal barrier pivot between the first and second positions.

29 Claims, 4 Drawing Sheets

VEHICLE BARRIER HAVING A PIVOTAL VEHICLE BARRICADE AND A COOPERATING PIVOTAL SIGNAL BARRIER

BACKGROUND OF THE INVENTION

1. Field of the Invention

The present invention relates generally to traffic barriers and, more particularly, to vehicle barriers having a vehicle barricade and a cooperating pivotal signal barrier.

2. Description of the Prior Art

It is known to employ signal barriers such as gate arms as traffic controllers to restrict vehicle passage on a roadway, or to a parking area, and at railroad signal crossings and the like. The function and advantages of such devices are well-known. The disadvantages are that a moving vehicle can crash through the gate arm and, therefore, the gate arm is not a positive physical barricade but rather a deterrent. However, signal barriers are not a deterrent to a terrorist or the like who is willing to go to any extreme to gain access to oil refineries, satellite communication stations, embassies, military bases, and other government installations.

It is known to use vehicle barricades as disclosed, for example, in U.S. Pat. Nos. 4,574,523 and 4,630,395 to the present inventor. The vehicle barricades disclosed are low lying in the roadway and moveable from a generally horizontal to an angularly disposed position for blocking the roadway. The advantages of these devices are that they are constructed to absorb the impact forces caused by the collision of a vehicle therewith. Furthermore, these devices are capable of stopping and preventing further movement of a vehicle, such as a truck loaded with explosives, which would be driven by a terrorist. The disadvantages are that these devices are expensive to construct and install and, because they are low lying, can be inadvertently impacted by an oncoming vehicle if the driver is not attentive. Also, in the event that such device would fail in the angularly disposed position, an inadvertent driver might drive his vehicle into the barrier.

U.S. Pat. No. 4,318,079 discloses a combination barrier having a gate arm and a vehicle barricade having tiger teeth. Two bell cranks are operated in response to an electric motor for causing simultaneous pivoting of the signal barrier with the tiger teeth. This device suffers from the disadvantages of only being able to utilize a small gate arm which only extends over a portion of the roadway. Further, this device is relatively complex and requires a high degree of maintenance.

The disclosed invention provides a novel and unique vehicle barrier having a low pivotal vehicle barricade and a cooperating pivotal signal barrier. The vehicle barricade and the signal barrier operate simultaneously in response to actuation of an hydraulic cylinder and piston assembly. The signal barrier pivots in response to operation of a ball nut which is actuated through a linkage arm connected to the barricade and moveable therewith in response to actuation of the hydraulic system. The device is simple in construction and low in maintenance. Consequently, one skilled in the art will appreciate that the disclosed vehicle barrier is a significant advance in the art.

OBJECTS AND SUMMARY OF THE INVENTION

It is an object of the present invention to provide a vehicle barrier having a relatively low pivotal vehicle barricade and a cooperating pivotal signal barrier which operate simultaneously in response to actuation of a linear motion device.

It is another object of the present invention to provide a transmission mechanism that converts linear motion into pivotal and rotary motion to move the vehicle barricade and signal barrier in response thereto.

It is another object of the present invention to provide a signal barrier that pivots in response to operation of a ball nut which is actuated through a linkage arm connected to the barricade and moveable therewith in response to actuation of an hydraulic system.

It is another object of the present invention to provide a vehicle barricade having a gate arm which extends a substantial distance across the roadway so as to provide a visual signal to an oncoming driver.

It is another object of the present invention to provide a vehicle barrier having a gate arm which, when placed in a horizontal position, extends horizontally and does not sag.

It is another object of the present invention to provide a portable vehicle barrier for positioning in a roadway or the like which requires no excavation of the roadway and which may be installed in a short amount of time with minimal effort.

It is another object of the present invention to provide a secondary vehicle barrier to be actuated in the event that a vehicle gains access past the first vehicle barrier.

It is another object of the present invention to provide a manually and automatically operated electrical control means for automatically detecting and producing a signal to move the secondary vehicle barricade into a position to block an oncoming vehicle's progress.

It is another object of the present invention to provide a vehicle barrier requiring little maintenance and having few moving parts.

It is another object of the present invention to provide a vehicle barrier which is simple in construction, effective in use, and economical to manufacture.

These and other objects and advantages of the present invention are achieved by providing a vehicle barrier having a vehicle barricade and a cooperating signal barrier for roadways or the like. The vehicle barrier has a housing. The vehicle barricade is pivotally connected to the housing and is pivotal between a first generally horizontal position and a second angularly disposed position. The first position is adapted for permitting vehicular passage thereover, and the second position is adapted for preventing vehicular passage therethrough by engagement of the vehicle barricade means with a vehicle. A signal barrier is provided which cooperates with the vehicle barricade and is pivotally connected to the housing between a first generally vertical position and a second generally horizontal position. The first position is adapted for permitting vehicular passage thereby, and the second position is adapted for signaling that the vehicle barricade is in the second position. Linear movement means are operably associated with the housing. Transmission means are operably associated with the linear movement means and the vehicle barricade and the signal barrier for converting linear movement thereof into pivotal movement of the vehicle barricade and signal barrier so that the barricade and the signal barrier pivot between the first and second positions.

A secondary barrier means is remotely spaced from the vehicle and positioned in the roadway. The secondary barrier means is pivotal between a first generally horizontal position and a second angularly disposed position. The first position is adapted for permitting vehicular passage thereover and the second position is adapted for preventing vehicular passage therethrough by engagement of a portion of said secondary barrier means with a vehicle. Manually and automatically operated electrical control means are provided, including switch means or the like, for controlling the position of the secondary barrier means dependent on when the switch means or the like is operated. The control means comprises a first manually operable emergency switch, which produces a signal for causing the secondary barrier means to be positioned in the second position. The control means also comprises a second switch which produces a signal in response to the gate barrier being impacted by a vehicle and thereby moved beyond the second position for causing the secondary barrier to be positioned in the second position. The control means also comprises speed detector means for sensing the speed of a moving vehicle which is moving between the first vehicle barrier and the secondary barrier means in the direction of the secondary barrier means. The speed detector means produces a signal causing the secondary barrier means to be positioned in the second position upon sensing that the moving vehicle is exceeding a predetermined speed.

A method of operating a vehicle barrier having a vehicle barricade and a cooperating signal barrier comprises the steps of: a) providing a housing; b) providing a vehicle barricade pivotably connected to the housing and pivotal between a first generally horizontal position and a second angularly disposed position, the first position adapted for permitting vehicular passage thereover, the second position adapted for preventing vehicular passage therethrough by engagement of the vehicle barricade with a moving vehicle; c) providing a signal barrier cooperating with the vehicle barricade and pivotably connected to the housing, the signal barrier pivotal between a first generally vertical position and a second generally horizontal position, the first position adapted for permitting vehicular passage thereby and the second position adapted for signaling that the vehicle barricade means is in the second position; d) providing linear movement means operably associated with the housing; e) providing transmission means operably associated with the linear movement means and with the vehicle barricade and signal barrier for converting linear movement thereof into pivotal movement of the vehicle barricade and the signal barrier so that the vehicle barricade and the signal barrier pivot between the first and second position; and f) causing movement of the linear movement means such that the vehicle barricade and the signal barrier pivot between the first and second positions.

These and other objects of the present invention will become apparent from the following detailed description and dependent claims.

The invention may best be understood with reference to the accompanying drawings wherein the illustrative embodiments are shown.

DETAILED DESCRIPTION OF THE INVENTION

Figure 1:
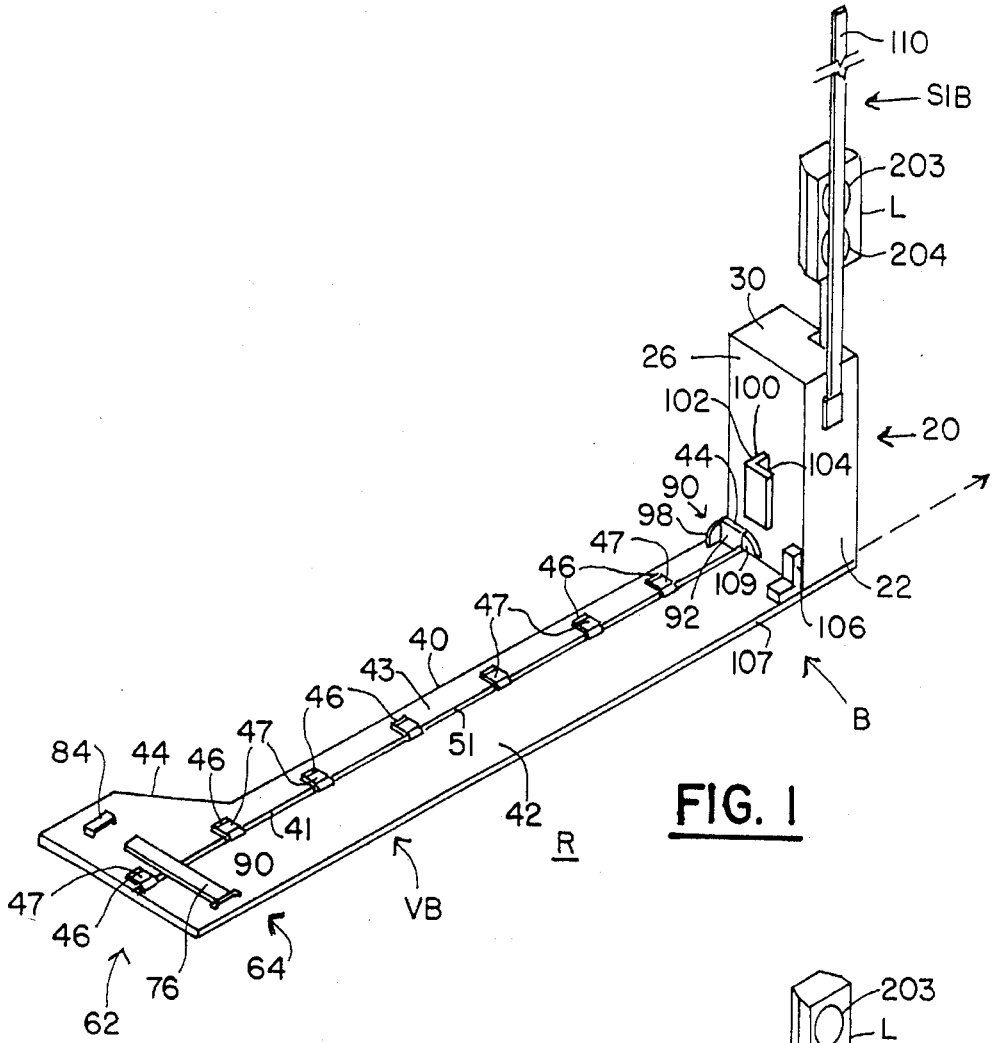
FIG. 1 is a perspective view of the vehicle barrier device of the present invention wherein the vehicle barricade is shown in a first generally horizontal position and the signal barrier is shown a first generally vertical position to permit vehicle traffic in both directions.
Figure 2:
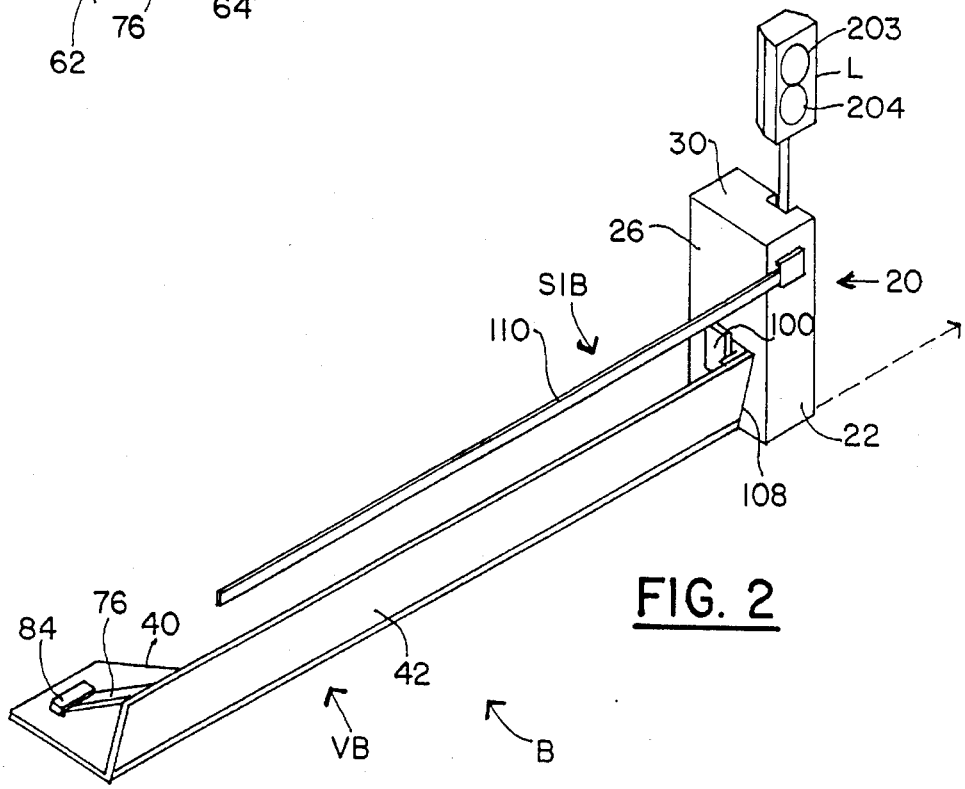
FIG. 2 is a perspective view of the device of FIG. 1 with the vehicle barricade shown in a second angularly disposed position and the signal barrier shown in a second generally horizontal position so as to prevent the flow of vehicular traffic in one or both directions.

A portable vehicle barrier or check point B, as best shown in FIGS. 1 and 2, is disposed for interdicting a roadway R. While the roadway R is disclosed, portable barrier B is intended for blocking or interdicting the ramp to an underground garage, vehicle entrance to a building, vehicle entrance to a parking lot and the like. Consequently, portable barrier B is capable of being moved to any location where the necessity of stopping and preventing the further movement of a vehicle, particularly a vehicle loaded with explosives is desired.

Figure 3:
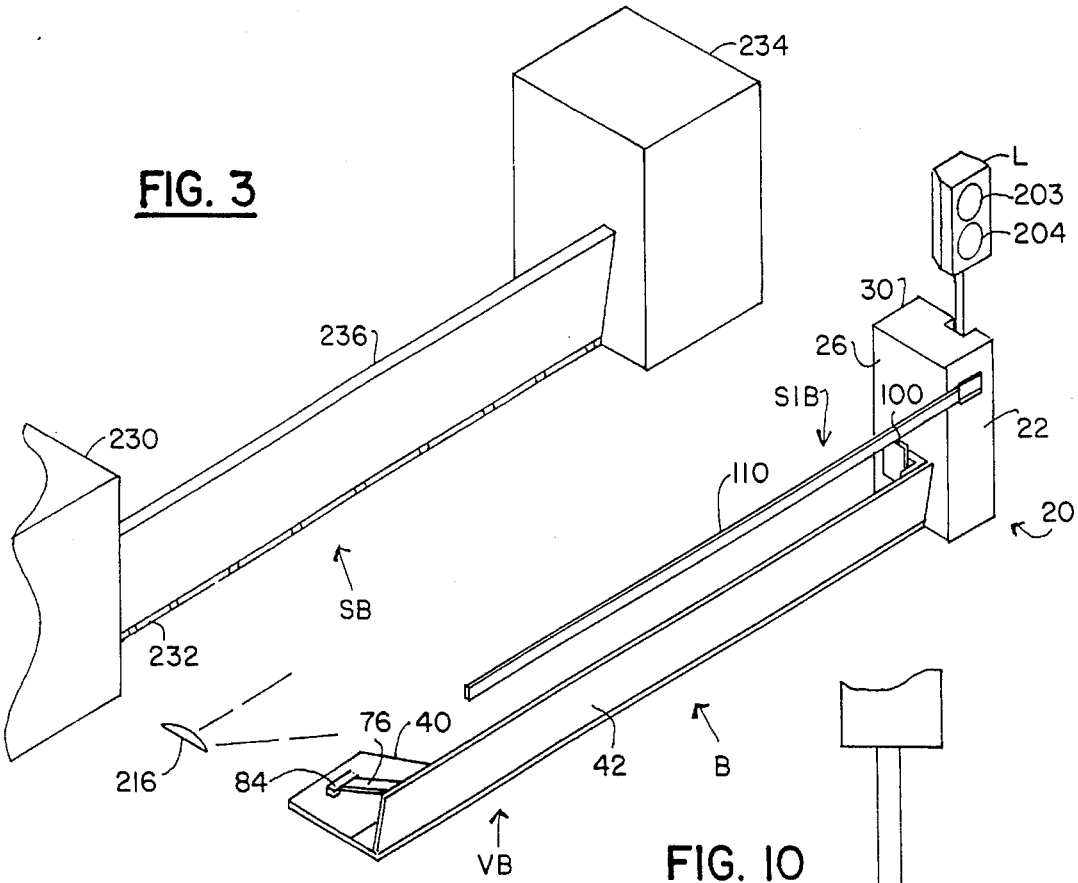
FIG. 3 is a perspective view of the vehicle barrier of the present invention and a secondary barrier and a speed detector therebetween, with both barriers shown in the position for stopping and preventing the further movement of a vehicle.

A secondary barricade SB, as best shown in FIG. 3, is used in conjunction with vehicle barrier B, and is disposed for interdicting the same roadway R. The disclosed barricade SB may be readily adapted for stopping trucks and other vehicles of a weight in excess of 8 tons and moving at speeds of up to 50 MPH. Secondary barrier SB is only to be actuated in the event of an emergency. Such an emergency may occur if a large vehicle smashes through vehicle barrier B.

As defined herein the term "vehicle barrier" is meant to include a signal barrier and a vehicle barricade. As defined herein the term "signal barrier" is meant to include a gate arm pivotal between a generally horizontal position and a generally vertical position. As defined herein, the term "vehicle barricade" or "barricade" is meant to include a low pivotal structure moveable between a generally horizontal position and an angularly disposed position.

According to the present invention, vehicle barrier B includes a signal barrier SIB and a vehicle barricade VB. Vehicle barricade VB, as best shown in FIGS. 1 and 2, is moveable between a first generally horizontal position and a second angularly disposed position. The first position is adapted for permitting vehicular passage thereover and the second position is adapted for preventing vehicular passage therethrough by engagement thereof with a moving vehicle. Signal barrier SIB, as best shown in FIGS. 1 and 2, is moveable in conjunction with vehicle barricade VB and is moveable between a first generally vertical position and a second generally horizontal position. The first position is adapted for permitting vehicular passage thereby and the second position is adapted for signaling that vehicular barricade VB is in the angularly disposed position so as to prevent a driver from inadvertently impacting the vehicle barricade VB.

Vehicle barrier B may be operated by drivers of vehicles approaching such a barrier using, for example, a card reader, numerical key pad, or the like. Alternatively, an attendant may operate vehicle barrier B using a gate up switch and a gate down switch known to those skilled in the art.

For convenience, vehicle barrier B and secondary vehicle barricade SB will be described in relation to the orientation illustrated, and consequently terms such as "horizontal," "vertical," "above," "below," "forward," "rearward," etc. as used herein are to be construed in the relative sense.

Housing assembly 20, as best shown in FIGS. 1 and 2, is disposed generally alongside roadway R. Housing assembly 20 is formed of a front wall 22 welded on one edge to a right wall 24 and welded on another edge to left wall 26 and welded on an upper edge to top wall 30, as best shown in FIGS. 1–2 and 12–13. Left wall 26 is disposed adjacent roadway R. Right wall 24 is welded on an opposite edge to rear wall 28 and welded on an upper edge to top wall 30. Left wall 26 is welded on an opposite edge to rear wall 28 and welded on an upper edge to top wall 30.

Figure 4:
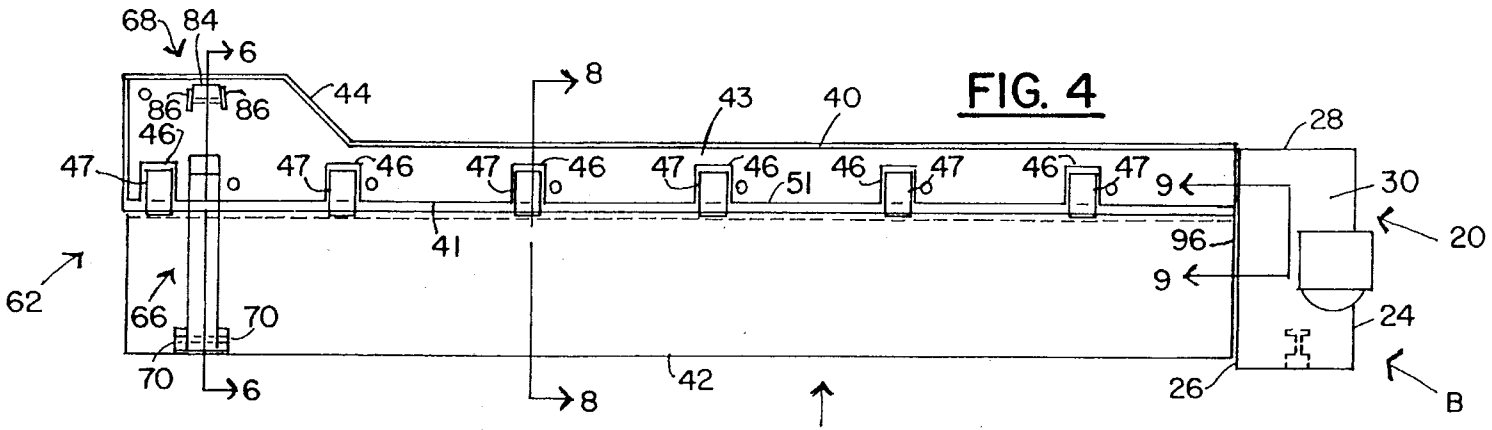
FIG. 4 is a top plan view of the vehicle barrier of the present invention with the vehicle barricade shown in the first generally horizontal position.
Figure 6:
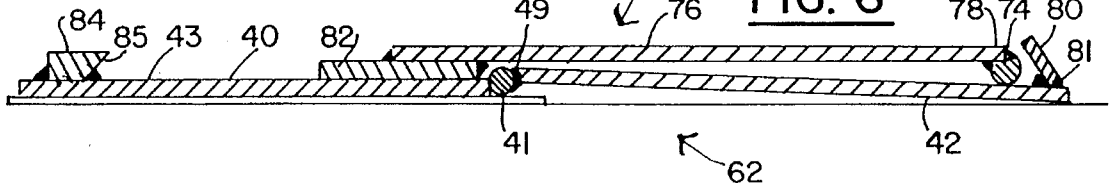
FIG. 6 is a cross-sectional view taken along line 6—6 of FIG. 4 showing the plate member, the gate member, and the reinforcing assembly.
Figure 8:
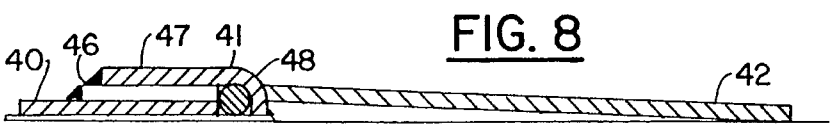
FIG. 8 is a cross-sectional view taken along line 8—8 of FIG. 4 showing the hinge plate, spacers, gate member, and plate member.
Figure 9:
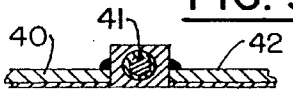
FIG. 9 is a fragmentary cross-sectional view taken along line 9—9 of FIG. 4 showing the elongated shaft mounted in a bushing with the housing assembly.
Figure 16:
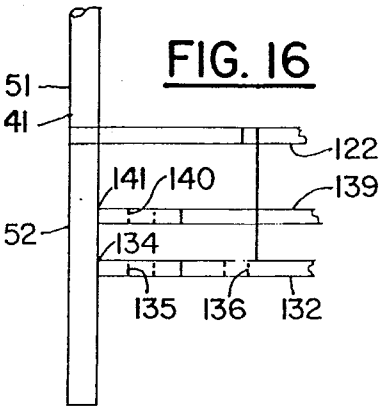
FIG. 16 is a fragmentary top plan view of the pivotal structure of FIG. 15.

Vehicle barricade VB includes, as best shown in FIGS. 4 and 6, a plate member 40, an elongated shaft 41, and a gate member 42. Plate member 40 is an elongated member disposed across roadway R and adjacent left wall 26 of housing assembly 20. Plate member 40 has a hinging portion 43 of constant width and an integral reinforcing portion 44 on an end thereof opposite housing assembly 20. At spaced intervals along the length of plate member 40 are welded a plurality of spacers 46. Above each of the spacers is welded a corresponding hinge plate 47 which has a bent downwardly extending portion 48, as best shown in FIG. 8. Elongated shaft 41 extends through and is captured by each of the bent portions 48, so as to prevent any movement of shaft 41, other than rotational movement. Shaft 41 is welded to a rear edge 49 of gate member 42, as best shown in FIG. 6. Elongated shaft 41 has an outer portion 51 which is coextensive with plate member 40 and gate member 42 and has an inner portion 52 extending through a hole in left wall 26 of housing assembly 20, as best shown in FIGS. 1 and 16. Inner portion 52 of shaft 41 cooperates with an internal transmission mechanism for raising and lowering gate member 42 as will be described in greater detail below. Gate member 42 pivots in conjunction with the rotation of shaft 41.

Figure 5:
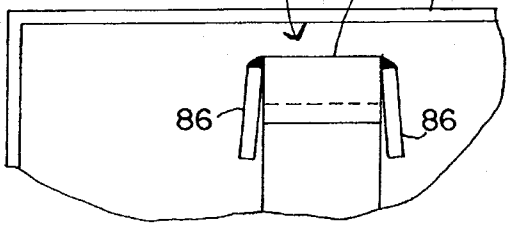
FIG. 5 is an enlarged top plan view of a stopping assembly shown in FIG. 4.
Figure 7:
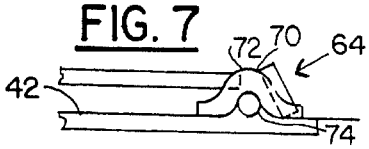
FIG. 7 is a fragmentary side elevational view of a retaining assembly taken along line 7—7 of FIG. 4.

A reinforcing assembly 62, as best shown in FIGS. 4 and 6, acts to reinforce gate member 42 in the event a moving vehicle impacts therewith. Reinforcing assembly 62 includes a retaining assembly 64, a reinforcing plate assembly 66, and a stopping assembly 68 all of which are disposed at the distal end of vehicle barricade VB because gate member 42 is cantilevered relative to housing assembly 20 so as to prevent or reduce the possibility of gate member 42 bending and thereby allowing a vehicle to crash through. Retaining assembly 64 includes a pair of retaining members 70 welded to gate member 42 near a forward edge thereof and which have a centrally bent portion 72 for receiving a cylindrical rod 74, as best shown in FIGS. 4 and 7. Rod 74 is welded along its longitudinal length, as best shown in FIG. 6, to an edge 78 of an elongated reinforcing plate 76. An angularly disposed plate member 80 is welded along a longitudinal edge 81 thereof to plate member 40 so as to protect retaining assembly 64 in the event an automobile impacts gate member 42 and to protect retaining assembly 64 from damage when an automobile wheel rolls thereover. Reinforcing plate 76 is welded along an opposite portion thereof to a plate member 82 which is disposed between reinforcing plate 76 and plate member 40. Stopping assembly 68, as best shown in FIGS. 5 and 6, is disposed on reinforcing portion 44 of plate member 40 and includes a wedge member 84 welded to reinforcing portion 44 and has an angularly disposed surface 85 in a front portion thereof. A pair of angularly disposed members 86 are welded at opposite ends of wedge member 84, as best shown in FIGS. 4 and 5.

A guard assembly 90, as best shown in FIG. 1, is formed adjacent left wall 26 of housing assembly 20. Guard assembly 90 consists of a vertically oriented plate 92 welded along its bottom edge to plate member 40 and along its top edge to a horizontal plate 94. Horizontal plate 94 is welded on an opposite edge to housing assembly 20 so as to form a slot 96 as best shown in FIG. 4, which receives a pie-shaped member as will be described in greater detail below. A plate 98 is welded transverse to plate 92 so as to reinforce plate 92.

An angularly disposed L-shaped member 100, as best shown in FIGS. 1 and 2, is welded to left wall 26 as best shown in FIG. 1. Member 100 has a portion 102 extending outwardly from left wall 26 and an integral portion 104 extending parallel to wall 26. An elongated member 106, having a rectangular or square cross-section, is welded to an upper surface 107 of gate member 42 along the right edge 108 thereof. A plate member 109 having a pie-shaped configuration is welded along a right edge 108 of plate 42 and is at least partially disposed within slot 96.

Signal barrier SB includes a gate arm 110 which extends across a substantial portion of roadway R, as best shown in FIG. 2. Gate arm 110 is constructed of light weight aluminum or wood. Gate arm 110 is pivotably mounted at one end thereof to a shaft rotatably mounted within housing assembly 20 as will be described in greater detail below.

Vehicle barricade VB and signal barrier SIB are moveable by a transmission mechanism 120 disposed within housing assembly 20, which includes a pivotal structure 122, cylinder and piston means 124, a rod assembly 126, an upper ball nut assembly 128, and a lower ball nut assembly 130, as best shown in FIGS. 10–14. Mechanism 120 is operable so as to move vehicle barricade VB and signal barrier SIB to or from the first position to the second position, so as to control the flow of traffic in one or both directions.

Figure 15:
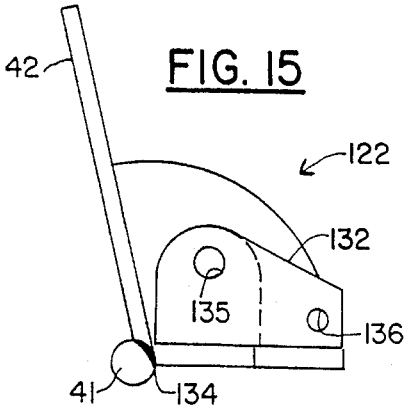
FIG. 15 is a side elevational view of a pivoting structure.

Pivotal structure 122 is welded to inner portion 52 of elongated shaft 41, as best shown in FIGS. 15 and 16. Pivotal structure 122 includes a first plate member 132 welded at an edge 134 thereof to inner portion 52 of shaft 41. First plate member 132 extends radially outwardly from shaft 41 and has a lower ball nut aperture 136. First plate member 132 also has an aperture 135 spaced from aperture 136 as best shown in FIG. 15. A second plate member 139 is welded at an edge 141 thereof to inner portion 52 of shaft 41 and is parallel to first plate member 132 and is spaced along shaft 41 from first plate member 132 and has an aperture 140 which is concentric and aligned with aperture 135. Apertures 135 and 140 are spaced radially closer to shaft 41 then aperture 136.

Cylinder and piston means 124 are attached on one end to housing assembly 20 by a pair of apertured lugs 142 each having an aperture 143. Apertured lugs 142 each are welded on an edge 144 to inside surface 145 of front wall 22, as best shown in FIGS. 10–14. Piston portion 146 of cylinder and piston means 124 is pivotally secured through pin 150 to pivotal structure 122 through apertures 135 and 140. Cylinder portion 155 is pivotally secured through pin 148 extending through apertures 143. It will be understood that cylinder and piston means 124 are preferably any conventional double acting hydraulic cylinder known to those skilled in the art. It will be understood, however, that any conventional pneumatic cylinder or electrical linear motion device may be used in this application known to those skilled in the art.

Rod assembly 126 has upper ball nut assembly 128 threadingly engaged thereto at an upper end thereof and lower ball nut assembly 130 threaded engaged therewith and attached thereto at a lower end thereof. Rod assembly 126 includes an elongated cylindrical rod 152 having an internally threaded portion 153 at an upper end thereof and an internally threaded portion 154 at a lower end thereof. Upper ball nut assembly 128 has an externally threaded portion 155 which is threadedly engaged into cooperating upper internally threaded portion 153. A hexagonal nut 156 having internal threads is threadedly engaged with cooperating threaded portion 155 of upper ball nut assembly 128 and, after the correct engagement of ball nut assembly and rod is determined, nut 156 is tightened down on the upper end of rod 152 so that further movement of threaded portion 155 of upper ball nut assembly 128 and internally threaded portion 153 is prevented. Lower ball nut assembly 130 is similarly attached to threaded portion 154 of rod 152 at a lower end thereof.

Figure 11:
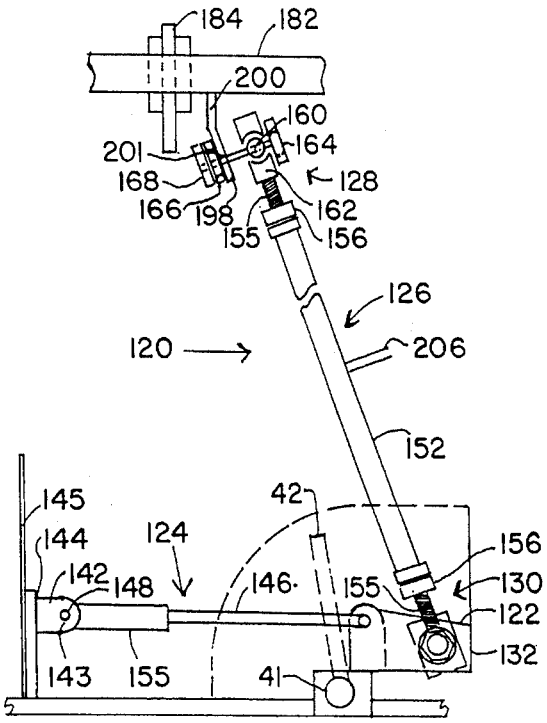
FIG. 11 is a enlarged fragmentary view of FIG. 10, showing the upper ball nut assembly partially in section.
Figure 17:
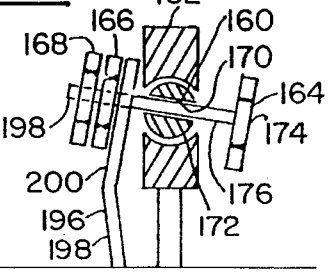
FIG. 17 is a fragmentary cross-sectional view of the ball nut assembly of FIG. 11.
Figure 14:
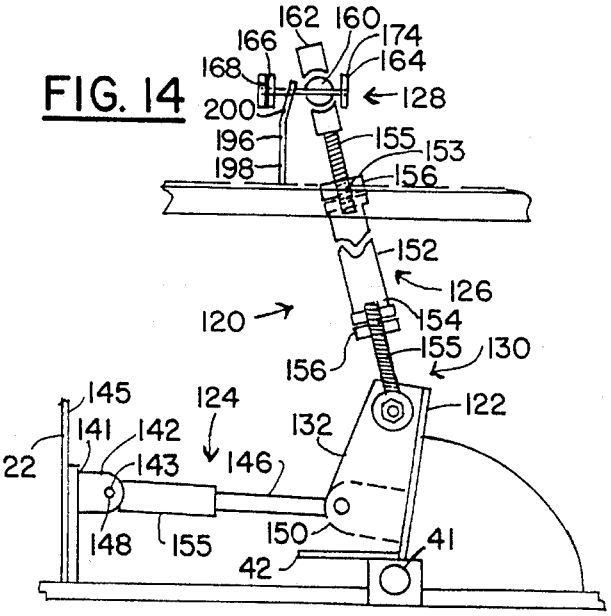
FIG. 14 is an enlarged fragmentary view of FIG. 12, showing the upper ball nut assembly partially in section and the cylinder and piston means in the retracted position.

Upper ball nut assembly 128, as best shown in FIGS. 11, 14, and 17 includes a ball shaped member 160, a containing member 162, a bolt 164, a first nut 166 and a second nut 168. Upper ball nut assembly 128 and lower ball nut assembly 130 are self-aligning, self-lubricating low speed oscillation rod end bearings, preferably available from Heim Me-12 under their part number M81935/1-12. Ball shaped member 160 is of a hardened steel material and has an aperture 170 therethrough. Containing member 162 is constructed of brass and has a interior space conforming substantially to that of the exterior surface of ball shaped member 160 but is slightly larger than ball shaped member 160 so as to allow pivotal and rotational movement of containing member 162 relative thereto. Containing member 162 has an aperture 172 therethrough substantially aligned with aperture 170. Bolt 164 has a headed portion 174, and a shank portion 176 integral therewith which extends through apertures 170 and 172. Surrounding shank 176 is a smooth sleeve 178 substantially coextensive with apertures 170 and 174. Shank 176 has a threaded portion 180.

Figure 10:
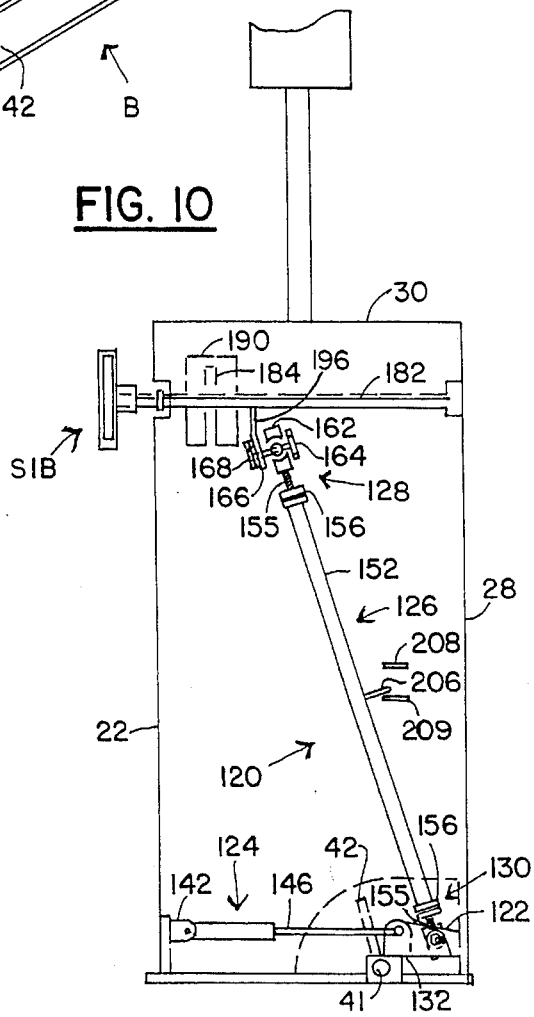
FIG. 10 is a side elevational view of the vehicle barrier with the right wall of the housing removed and the signal barrier and vehicle barricade in the second position, showing the upper ball nut assembly partially in section and the cylinder and piston means in an extended condition.
Figure 12:
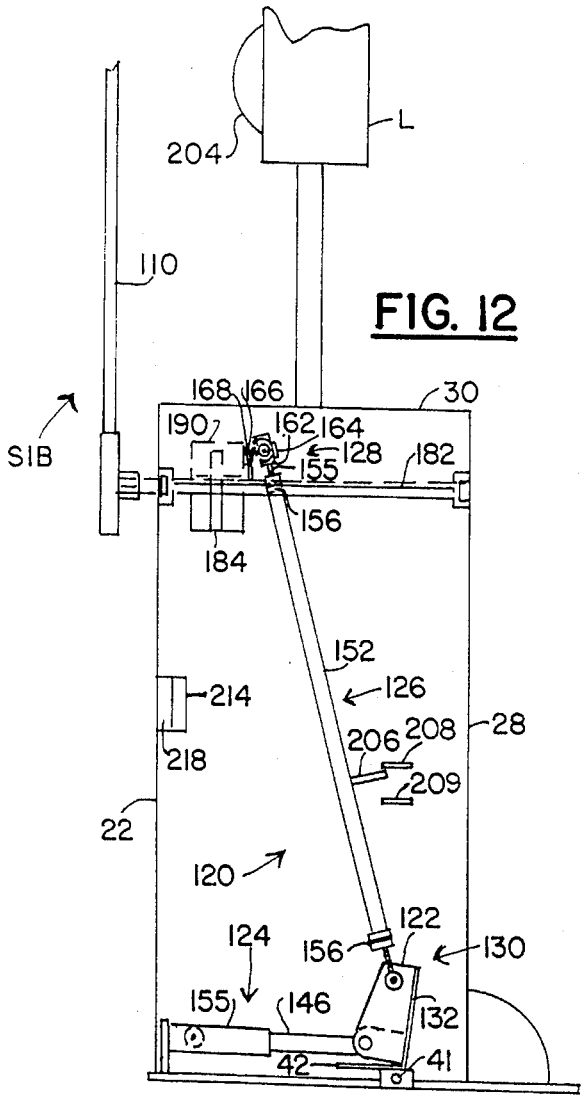
FIG. 12 is a fragmentary view similar to FIG. 10 with the signal barrier and vehicle barricade shown in the first position, showing the upper ball nut assembly partially in section, and the cylinder and piston means in a retracted condition.
Figure 13:
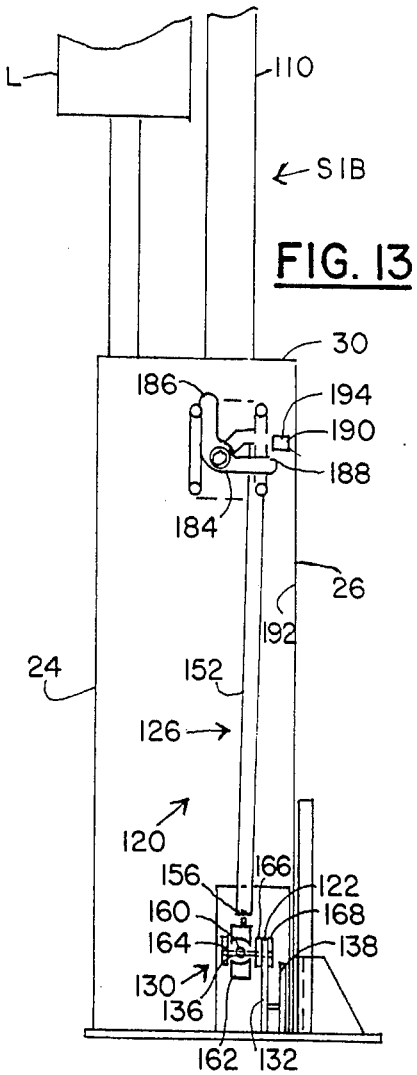
FIG. 13 is a rear fragmentary elevational view of the device of FIG. 12 with the rear wall of the housing assembly removed.

A shaft 182, as best shown in FIGS. 10 and 12, is rotatably mounted in an upper portion of housing assembly 22 and is pivotably attached to gate arm 110 at an end portion thereof. An L-shaped member 184, as best shown in FIG. 13, is pivotably attached, such as by welding, to shaft 182 and has one portion 186 extending radially outwardly therefrom and a second portion 188 integral with the first portion and extending transversely thereto. A stop member 190 is welded to an inside surface 192 of left wall 26 and has a horizontal portion 194 extending inwardly therefrom. A connecting member 196 is welded to shaft 182 and extends radially outwardly therefrom as best shown in FIGS. 10 and 17. Connecting member 196 has a first portion 200 extending transverse to the longitudinal axis of shaft 182 and a second portion 198 which is bent relative to first portion, as best shown in FIG. 11, and has an aperture 201 therethrough.

As best shown in FIG. 11, a threaded portion of upper ball nut assembly 128 extends through aperture 201 of second portion 198 of connecting member 196. First nut 166 and second nut 168 are disposed on an opposite side of connecting member 196 and are tightened so as to prevent relative movement of nuts 166 and 168 to each other and to keep ball nut assembly 128 in engagement with connecting member 196. It should be noted that the ends of containing member 162 are spaced relative to headed portion 176 and second portion 198 so as to allow containing member 162 to rotate and pivot relative to ball shaped member 160.

Lower ball nut assembly 130, as best shown in FIG. 13, similarly has a ball shaped member 160, containing member 162, bolt 164, a first nut 166, and a second nut 168, each of which is the same as the corresponding parts of upper ball nut assembly 128 and need not be further described. Lower ball nut assembly 130 is attached to first plate member 132 through lower ball nut aperture 136. As described above with respect to upper ball nut assembly 128, first nut 166 and second nut 168 are disposed on an opposite side of first plate 132 and are threadly engaged with the threaded portion of lower ball nut assembly 130 which extends through aperture 136. Nuts 166 and 168 are tightened to each other, thereby preventing relative movement of nuts 166 and 168 to each other and to keep ball nut assembly 130 engaged with first plate member 132. In this manner, containing member 162 of lower ball nut assembly 130 is able to pivot and rotate relative to ball shaped member 160. As noted above, containing member 162 has its ends spaced from headed portion 176 and first nut 166 so as to allow containing member 162 to pivot and rotate relative thereto.

Light L, as best shown in FIG. 2, is a conventional type lighted visual traffic signal displaying a red and a green light so as to visually indicate to traffic moving in one direction whether the signal barrier SIB and vehicle barricade VB will permit vehicles to pass therethrough. Red light 203 is activated when signal barrier SIB and vehicle barricade VB are not in the first position. Green light 204 is activated when signal barrier SIB and vehicle barricade VB are in the first position so as to allow traffic to flow thereby. Red light 203 and green light 204 are activated and deactivated in a conventional manner.

Rod assembly 126 has a transverse member 206 welded thereto, as best shown in FIGS. 10 and 12. Spaced above transverse member 206 is an upper limit switch 208 and spaced below transverse member 206 is a lower limit switch 209. Each of these limit switches is suitably connected to an inner wall of housing assembly 22. Upward motion of rod assembly 126 will cause transverse member 206 to be brought into engagement with upper limit switch 208 so as to deactivate the movement of cylinder and piston means 124 in one direction, and similarly movement in a downward direction will cause transverse member 206 to engage lower limit switch 209 so as to deactivate cylinder and piston means 124 in an opposite direction as will be described in greater detail below.

A gate up switch is provided for moving vehicle barricade B to the first position and a gate down switch is provided for moving vehicle barricade B to the second position.

Operation of secondary barrier SB is controlled by either a manually operable switch, a switch 214 inside housing assembly 22 or by a speed detector 216. Manually operable switch is remote from housing assembly 20 and produces a signal when activated for causing secondary barrier SB to be positioned in a second angularly disposed position. Switch 214 is mounted within housing assembly 20, as best shown in FIG. 12, and mounted adjacent switch 214 is a spring 218. Switch 214 is activated in the event that gate member 42 is brought beyond its second position in the event, for example, that gate member 41 is impacted by a moving vehicle. In order for switch 214 to be activated, a force of 5,000 lbs. must be exerted on spring 218 so as to compress it thereby permitting gate 42 to be brought into engagement with switch 214 member activating secondary barrier SB. Alternatively, switch 214 can actuate an alarm for indicating that vehicle barrier B has been impacted. Speed detector 216 as best shown in FIG. 3 is disposed between vehicle barrier B and secondary barrier SB which senses the speed of a moving vehicle which is moving between vehicle barrier B and secondary barrier SB in the direction of secondary barrier SB. Speed detector 216 produces a signal for causing secondary barrier SB to be positioned in the second position upon sensing that the moving vehicle is exceeding a predetermined speed. A reset switch is provided for cancelling the effects of switch 214 and speed detector 216.

It is to be understood that any of the barricades disclosed in U.S. Pat. Nos. 4,574,523, 4,630,119, 4,630,395, 4,818,136, 4,826,349, 4,839,119 and 4,850,737 may be utilized in this application as a secondary barricade and each of the aforementioned patents is hereby incorporated by reference into this specification. A brief explanation of the operation of an exemplary secondary barricade as disclosed in U.S. Pat. No. 4,630,395 will be provided here.

Secondary barrier SB includes a first steel stanchion 230 contiguously disposed along one side of a base plate 232. Another similar second stanchion 234 is disposed along the other side of base plate 232. A barrier plate 236 is pivotally secured to base plate 232. A hydraulic actuator is secured to base plate 232 and barrier plate 236 and is moveable to raise and lower barrier plate 236. Further details of the construction and operation of secondary barrier SB can be found in that specification.

In operation, vehicle barrier B has a first position and a second position. In the first position, vehicle barricade VB is in the first generally horizontal position and signal barrier SIB is in the first generally vertical position. In this position as best shown in FIG. 1, traffic flow is unimpeded in either direction and green light 204 is activated, indicating to oncoming traffic that it is permissible to move without stopping at the vehicle barricade VB. Vehicle barrier B also has a second position for blocking and stopping and preventing the flow of traffic in one or both directions as best shown in FIG. 2. In the second position, vehicle barricade VB is in the second angularly disposed position and signal barrier SIB is in the second generally horizontal position. Red light 203 is activated, indicating to oncoming traffic that traffic should stop at vehicle barrier B.

Movement of vehicle barricade VB and signal barrier SIB from the first position to the second position is accomplished by hydraulic pressure being applied to cylinder and piston means 124, so as to extend the piston and cylinder means from its retracted position to its extended position. In the first position, gate arm 110 is in the generally vertical position, as best shown in FIG. 1, first and second plate members 132 and 138 of pivoting structure 122 extend vertically, as best shown in FIGS. 12 and 14, and gate member 42 is in the generally horizontal position, as best shown in FIG. 1. Linear movement of piston portion 146 of cylinder and piston means 124 causes pivoting structure 122 to move from the first position, thereby rotating elongated shaft 41 and causing rod assembly 126 to move angularly and downwardly from the first position to the second position, as best shown in FIGS. 10 and 11. Concurrent with movement of pivotal structure 122, gate member 42 is caused to pivot from the generally horizontal position to the angularly disposed position by rotation of elongated shaft 41. Downward movement of rod assembly 126 , from the orientation of FIG. 12 to that of FIG. 10, causes 90° rotation of shaft 182, thereby pivoting gate arm 110 from the generally vertical position to the generally horizontal position. It should be noted that the transmission mechanism is constructed and arranged such that 82° of movement of pivotal structure 122 and gate member 42 causes 90° of movement of gate arm 110. Movement from the first position to the second position is stopped by lower limit switch 209 which, when engaged by transverse member 206, shuts off the flow of hydraulic pressure and fluid to cylinder and piston means 124 thereby stopping the movement of piston portion 146. In the second position, L-shaped member 184 is supported on horizontal position 194 of stop member 190 so that gate arm 110 is maintained in the generally horizontal position. It should be noted that during this movement, upper ball nut and lower ball nut assemblies 128 and 130 respectively pivot relative to rod 152, thereby allowing movement of the mechanism. Movement from the second position to the first position is accomplished by reversing the steps noted above.

In the event that a moving vehicle impacts vehicle barricade VB, plate member 82 is wedged into wedge member 84 preventing further rearward movement of plate 76 and reinforcing the distal end of vehicle barricade VB. Elongated member 106 is captured by L-shaped member 100, thereby reinforcing gate member 42 even in the event that vehicle barricade VB is centrally impacted by a moving vehicle.

A first emergency switch is also provided for moving vehicle barrier B into the second position. A reset switch is provided for cancelling the effects of the emergency switch.

It should now be apparent that a vehicle barrier has been disclosed with having a signal barrier SIB and a vehicle barricade VB which move in conjunction with one another. The mechanism which causes such movement has few moving parts and therefore requires little maintenance. Also, it should be apparent that the vehicle barrier disclosed is a portable vehicle barrier and can be secured to a roadway or the like.

It should also be apparent from the foregoing detailed description that in the event that the portable vehicle barrier has been overcome, a heavy duty vehicle barricade is mounted within the roadway and means are provided, for use in an emergency situation, for activating the heavy duty barrier thereby preventing vehicles which can overcome the portable vehicle barricade from further progress on roadway R.

While this invention has been described as having a preferred design, it is understood that it is capable of further modifications, uses, and/or adaptations thereof following in general the principles of the invention including such departures that have been within known or customary practice in the art to which the invention pertains.

I claim:

1. A vehicle barrier having a vehicle barricade and a cooperating signal barrier for a roadway, said vehicle barrier comprising:

a) a housing;

b) a vehicle barricade pivotally connected to said housing and pivotal between a first generally horizontal position permitting vehicle passage and a second angularly disposed position preventing vehicle passage;

c) a signal barrier cooperating with said vehicle barricade pivotally connected to said housing and pivotal between a first generally vertical position and a second generally horizontal position;

d) a linear movement actuator operably associated with said housing; and e) a transmission operably associated with said linear movement actuator and with said vehicle barricade and said signal barrier for converting linear movement of said actuator into pivotal movement of both said vehicle barricade and said signal barrier so that said vehicle barricade and said signal barrier simultaneously pivot between said respective first and second positions.

2. The vehicle barrier according to claim 1, wherein said transmission includes:

a) a first shaft operatively associated with said signal barrier;

b) a vertical rod having spaced upper and lower ends;

c) an upper ball nut assembly rotatably and pivotally connected to said upper end and drivingly coupled to said shaft;

d) a lower ball nut assembly rotatably and pivotally connected to said lower end; and e) connecting means in motion transmitting relation with said lower ball nut assembly, said linear movement actuator, and said vehicle barricade for causing pivoting of said vehicle barricade and said signal barrier in response to operation of said linear motion actuator.

3. The vehicle barrier according to claim 2, wherein:

a) each of said ball nut assemblies includes a ball shaped member having an aperture therethrough and an exterior surface, a containing member formed with an interior space conforming substantially to the exterior surface of said ball shaped member and adapted to permit said containing member to rotate and pivot relative to said ball shaped member and having an aperture therethrough aligned with said aperture in said ball shaped member, a bolt extending through said apertures, a sleeve disposed between said bolt and said apertures, and means for retaining said bolt in said apertures.

4. The vehicle barrier according to claim 3, wherein:

a) means are operably associated with said ball nut assemblies for adjusting and setting the spacing between said first and second ball nut assemblies.

5. The vehicle barrier according to claim 4, wherein:

a) said adjusting means includes a first threaded portion formed on said upper containing member, a second threaded portion formed on said lower containing member, a third threaded portion formed on said rod upper end in cooperative threaded engagement with said first threaded portion, a fourth threaded portion formed on said rod lower end in cooperative threaded engagement with said second threaded portion, and locking means operably associated with said rod member for selectively locking said first and third and said second and fourth threaded portions relative to each other so that movement relative thereto is prevented.

6. The vehicle barrier according to claim 3, wherein:

a) said housing includes a second shaft rotatably mounted therein; and b) said connecting means includes pivoting structure having a pair of lugs each having an aperture formed therein, a first portion engaged with said vehicle barricade, a second portion engaged with said bolt of said lower ball nut, and an aperture formed therethrough for receiving said second shaft.

7. A vehicle barricade according to claim 6, wherein:

a) an upper ball nut connecting member is secured to said second shaft and rotatable therewith, said upper ball nut connecting member extends radially outwardly from said second shaft and has a bent portion engaged with said bolt of said upper ball nut.

8. The vehicle barrier according to claim 2, wherein:

a) said vehicle barricade includes an elongated plate member having a first end secured to said housing and a second end remote from said housing, and a gate member hingedly attached to said plate member.

9. The vehicle barrier according to claim 8, wherein:

a) said gate member includes a pie-shaped portion extending transverse to said elongated plate member and pivotal therewith; and b) a second shaft is pivotally secured to said gate member and rotatable therewith.

10. The vehicle barrier according to claim 9, wherein:

a) said housing includes a slot in which said pie-shaped portion is disposed when said vehicle barricade is in said second position.

11. The vehicle barrier according to claim 8, further including:

a) a reinforcement member movable between a first generally horizontal position and a second angularly disposed position, said reinforcement member is pivotally secured to said gate member and engageable with a fixed member on said plate member so that movement of said vehicle barricade from said first position to said second position causes associated movement of said reinforcement member and engagement of said reinforcement member with said fixed member for reinforcing said gate member in the event that said gate member is impacted by a moving vehicle.

12. The vehicle barrier according to claim 8, wherein:

a) said housing has a side wall;

b) an angularly disposed member is fixedly attached to an outer surface of said side wall and has a first portion extending outwardly from said outer surface and a second portion integral therewith and extending parallel to said outer surface; and c) said gate member has a rear surface and a projecting portion extending therefrom, said projecting portion is engageable with said angularly disposed member.

13. The vehicle barrier according to claim 12, wherein:

a) said angularly disposed member and said projecting portion are spaced from each other when said gate member is in said second position.

14. A vehicle barrier according to claim 2, wherein:

a) said housing has a front wall, a left wall, a right wall and a rear wall;

b) said rod is angularly disposed relative to said walls of said housing means; and c) said rod upper end is spaced further from said rear wall than said rod lower end, and said rod upper end is spaced closer to said left wall than said rod lower end.

15. A vehicle barrier according to claim 14, wherein:

a) said housing includes a pair of apertured lugs secured to said front wall; and b) said linear movement actuator has one end mounted to said apertured lugs and an opposite end mounted to said connecting means.

16. A vehicle barrier according to claim 2, further including:

a) first and second limit switches engageable with a portion of said rod for controlling pivoting of said vehicle barricade.

17. The vehicle barrier according to claim 1, wherein:

a) said linear movement actuator is a cylinder and piston assembly having a retracted position and an extended position.

18. A vehicle barrier according to claim 17, wherein:

a) said linear movement actuator extends generally parallel to the roadway.

19. The vehicle barrier according to claim 1, wherein:

a) said vehicle barricade rotates substantially 82° between said first and second positions; and b) said signal barrier rotates substantially 90° between said first and second positions.

20. The vehicle barricade according to claim 1, wherein:

a) said transmission is adapted for positioning said vehicle barricade in said first position when said signal barrier is in said first position.

21. The vehicle barrier according to claim 1, wherein:

a) said signal barrier includes a gate arm.

22. A vehicle barrier according to claim 21, further including:

a) said housing has a side wall;

b) a stop member extends inwardly from said side wall; and c) an L-shaped member is fixedly secured to a first shaft and rotatable therewith, said L-shaped member having a first portion engageable with said stop member when said signal barrier is in said first position for maintaining said gate arm in a vertical orientation and a second portion engageable with said stop member when said signal barrier is in said second position so as to maintain said gate arm in a horizontal orientation.

23. A vehicle barrier according to claim 1, further including:

a) a vehicle control signal including a first lighted signal activated when said linear movement actuator is in a first positions, and a second lighted signal activated when said linear movement actuator is in a position other than said first position.

24. A vehicle barrier according to claim 1, further including:

a) a secondary barrier remotely spaced from the said vehicle barricade and positioned in the roadway, said secondary barrier moveable between a first generally horizontal position and a second angularly disposed position; and b) control means operably associated with said secondary barrier for controlling the position of said secondary barrier.

25. A vehicle barrier accorded to claim 24, wherein:

a) said control means comprises an impact actuated switch which produces a signal in response to said vehicle barricade being impacted by a vehicle for causing said secondary barrier to be positioned in said second position.

26. A vehicle barrier according to claim 24, wherein:

a) said control means comprises speed detector means for sensing the speed of a vehicle moving between said vehicle barricade and said secondary barrier.

27. A vehicle barrier according to claim 1, wherein: a) said transmission is disposed within said housing.

28. A method of operating a vehicle barrier having a vehicle barricade and a cooperating signal barrier, comprising the steps of:

a) providing a housing;

b) providing a vehicle barricade pivotally connected to the housing and pivotal between a first generally horizontal position and a second angularly disposed position;

c) providing a signal barrier cooperating with the vehicle barricade and pivotably connected to the housing and pivotal between a first generally vertical position and a second generally horizontal position;

d) providing a linear movement actuator within the housing;

e) providing a transmission in operable association with the linear movement actuator and the vehicle barricade and signal barrier for converting linear movement of the actuator into simultaneous pivotal movement of the vehicle barricade and the signal barrier; and f) operating the linear movement actuator and thereby causing simultaneous pivoting of the vehicle barricade and the signal barrier.

29. A method according to claim 28, including the steps of:

a) providing a shaft operatively associated with the signal barrier;

b) providing a rod having spaced upper and lower ends;

c) providing an upper ball nut assembly rotatably and pivotally connected to the rod upper end and drivingly coupled to the shaft;

d) providing a lower ball nut assembly rotatably and pivotally connected to the rod lower end;

e) providing a cylinder and piston assembly having a retracted position and an extended position as the linear movement actuator;

f) providing connecting means in motion transmitting relation with the lower ball nut, the linear movement actuator and the vehicle barricade for causing movement of the vehicle barricade and the signal barrier in response to movement of the cylinder and piston assembly between the retracted and extended position;

g) causing the cylinder and piston assembly to move from the retracted position to the extended position;

h) pivoting the connecting means in a first direction for thereby causing the vehicle barricade means to pivot from the first position to the second position; and i) moving the rod concurrently with the pivoting step and thereby causing rotation of the shaft and rotation of the signal barrier from the first position to the second position.

* * * * *